US005520595A

United States Patent [19]

Lee

[11] Patent Number: 5,520,595

[45] Date of Patent: May 28, 1996

[54] TRAINING DEVICE FOR ICE SKATING JUMP

[76] Inventor: Allan W. Lee, P.O. Box 318, Haileybury, Ontario, Canada, P0J-1K0

[21] Appl. No.: 181,224

[22] Filed: Jan. 13, 1994

[30] Foreign Application Priority Data

Jan. 28, 1993 [CA] Canada ..... 2088315

[51] Int. Cl.[6] ..... A63B 5/16; A63C 3/00

[52] U.S. Cl. ..... 482/17; 482/8; 482/15; 280/809; 434/247; 206/573; 206/579; 250/221; 250/522.1

[58] Field of Search ..... 482/14–18, 8, 482/51; 273/1.5 A, 310, 57.2, 29 R, 29 A; 116/4, DIG. 26; 33/DIG. 3; 340/323 R, 138, 556; 356/138; 434/247, 253; 455/90; 206/45.11, 45.15, 579, 515, 573, 579; 250/491.1, 221, 522.1; 280/809

[56] References Cited

U.S. PATENT DOCUMENTS

| | | | |
|---|---|---|---|
| 776,042 | 11/1904 | Acheson | 206/45.11 |
| 1,929,273 | 10/1933 | Crago | 250/221 |
| 2,113,899 | 4/1938 | Oram | 340/323 |
| 2,299,798 | 10/1942 | Colson et al. | 340/323 |
| 3,727,207 | 4/1973 | Missio et al. | 356/5 |
| 3,836,960 | 9/1974 | Gehman et al. | 342/27 |
| 4,171,907 | 10/1979 | Hill et al. | 356/5 |
| 4,422,647 | 12/1983 | Wilson et al. | 340/323 R |
| 4,673,287 | 6/1987 | Rickus | 356/4 |
| 4,730,190 | 3/1988 | Win et al. | 356/5 |
| 5,087,047 | 2/1992 | McConnell | 250/221 |
| 5,294,912 | 3/1994 | Bednarz et al. | 340/557 |

FOREIGN PATENT DOCUMENTS

| | | | |
|---|---|---|---|
| 0229035 | 10/1985 | German Dem. Rep. | 482/15 |
| 2751154 | 5/1979 | Germany | 273/29 B |
| 3030204 | 3/1982 | Germany | 482/15 |
| 3029646 | 3/1982 | Germany | 482/15 |

*Primary Examiner*—Richard J. Apley
*Assistant Examiner*—Victor K. Hwang

[57] ABSTRACT

A beam of electromagnetic wave is suspended at an adjustable distance above a floor or an ice surface by a mechanism that generates electromagnetic wave energy and detects that same energy bounced back from a reflector plate placed a distance apart from the generator source. This beam of electromagnetic transmission suspended across the distance between the transceiver and reflector keeps an electric switch open and an electric alarm disabled or silent. Whenever the invisible beam is broken or cut by any obstruction, such as a skate's boot or leg, the alarm mechanism is energized and it will signal an interruption. The alarm signal indicates how high the skater did not reach, so that a practicing skater can be certain of step by step upward progress by constantly trying to keep the alarm off or silent.

1 Claim, 5 Drawing Sheets

TRAINING DEVICE FOR ICE SKATING JUMP

BACKGROUND OF THE INVENTION

1. Field of the Invention

The present invention relates to a training device for practice of high-jump skills. More specifically, the present invention relates to a measuring device for use in jumping practice by ice-skaters. Furthermore, specifically, the present invention enables an ice-skater to receive immediate feedback relating to the height of a jump.

2. Prior Art

Skating jumps have been taught by a coach's explanation and demonstration of the proper technique. The practicing skater then attempts the jump according to instructions. However, no measurements are given or taken to indicate a skater's readiness for the attempt of a particular jump, such as a Lutz or Axel.

No device is known for use to measure the height of an actual jump performed by a skater on the ice surface.

Such measurements of jumping height have been taken only in off-ice practices.

Jumping practice off-ice, however, is unlike jumping practice on-ice in one important aspect. It cannot simulate the take-off edges of on-ice practice and therefore is ineffective for training skating jumps.

Furthermore, there was never emphasis in training an ice-skater to concentrate on improving only the height element of a free-style jump. A skater learns, for example, a Lutz jump in its entirety, trying to master both elements (rotation and height) together. The present invention encourages skaters to practice attaining higher jumps and enables them to measure actual results.

To date electromagnetic transceivers (transmitter and receiver) have been used in automatic devices such as door-openers, burglar alarms and other applications, but it was never used in measuring high-jumps on-ice or off-ice.

SUMMARY OF THE INVENTION

The principal object of the present invention is to provide a device for measuring the height of a skater's jump in actual performance on the ice surface.

It also is an object of the present invention to provide such a device which has a measuring scale, an invisible wave-beam that is adjustable up and down, and an alarm indicating mechanism, so that a practicing skater can monitor progress without the danger of tripping over a physical obstruction like a solid cross-bar.

Another object is to provide such a device in portable form that can be disassembled and reassembled quickly for transportation to and from a training site, such as the ice surface of a skating rink.

A further object is to provide such a device which will enable trainers or coaches to measure accomplished skaters and determine what minimum and average heights are required for the successful completion of different types of jumps. Such collection of measured data can be used to guide practicing skaters in their course of training.

The foregoing objects can be accomplished by providing a training device having an invisible beam of radiation suspended between two upright sections. One section contains the beam-radiation transceiver, an alarm device and power supply, and the other section contains the reflector and a measuring scale. Both transceiver and reflector are movable up and down, for example, along sets of corresponding graduated tracks. With a control switch, select the visible signaling device while doing system alignment for the-transceiver and reflector, then switch if so chosen to audible alarm mode for normal operation. The alarm when properly adjusted will sound only during the instant when the beam of electromagnetic radiation is interrupted and resets itself after the beam is restored.

DETAILED DESCRIPTION

Figure 1A:
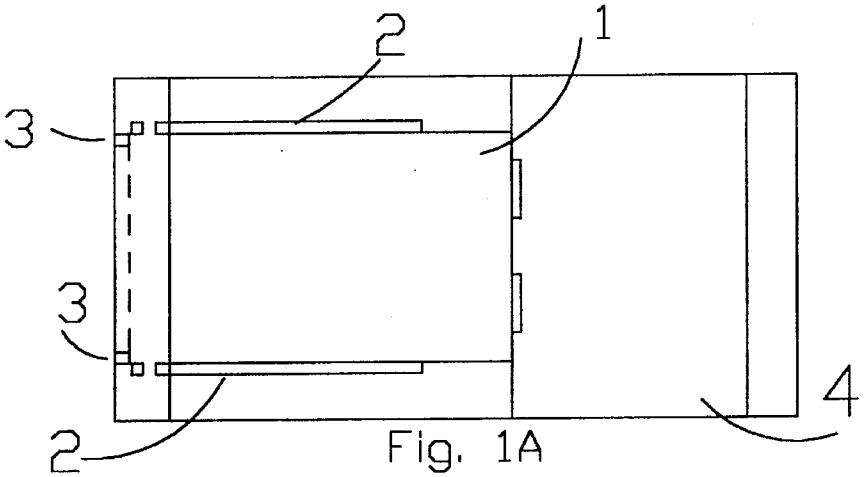
FIG. 1 is the top view and FIG. 2 is the front view of the two sections of the housing for the measuring device in accordance with the present invention.
Figure 1B:
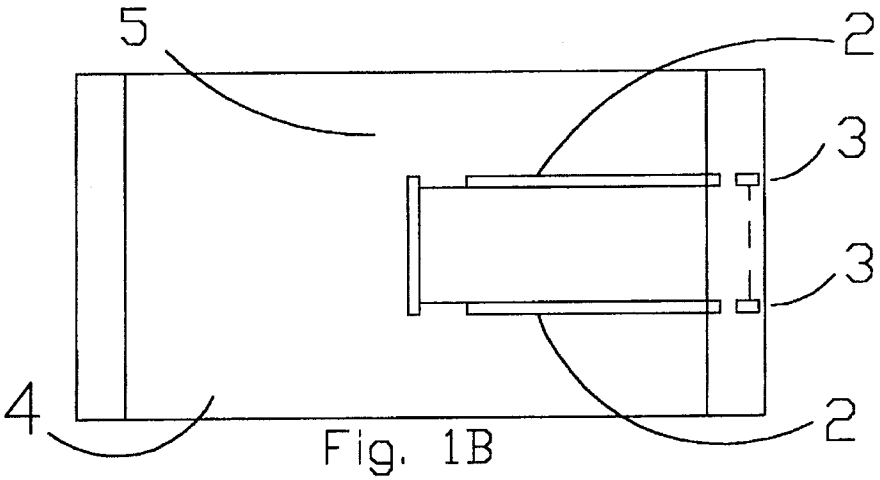
Figure 2B:
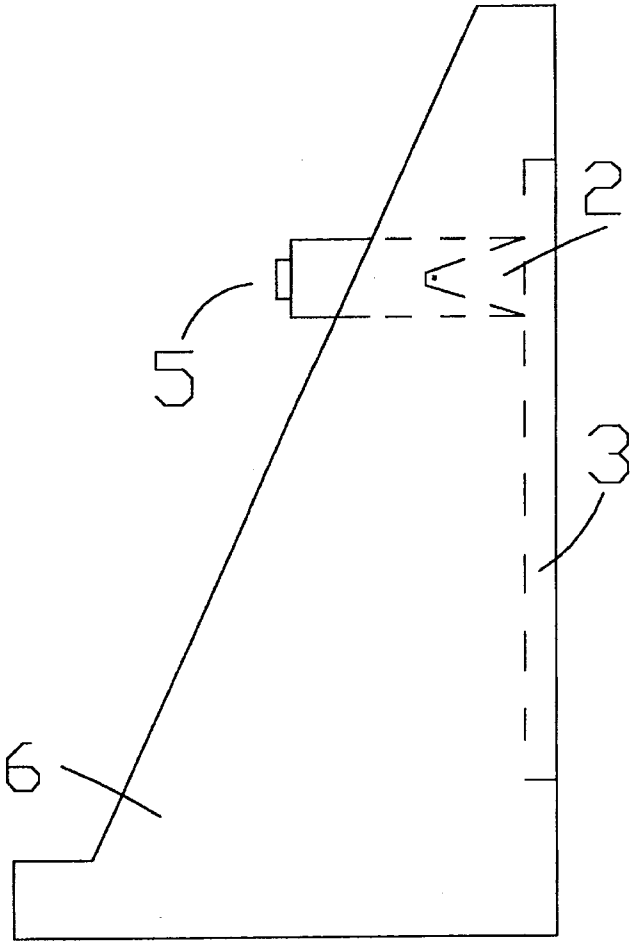
Figure 2A:
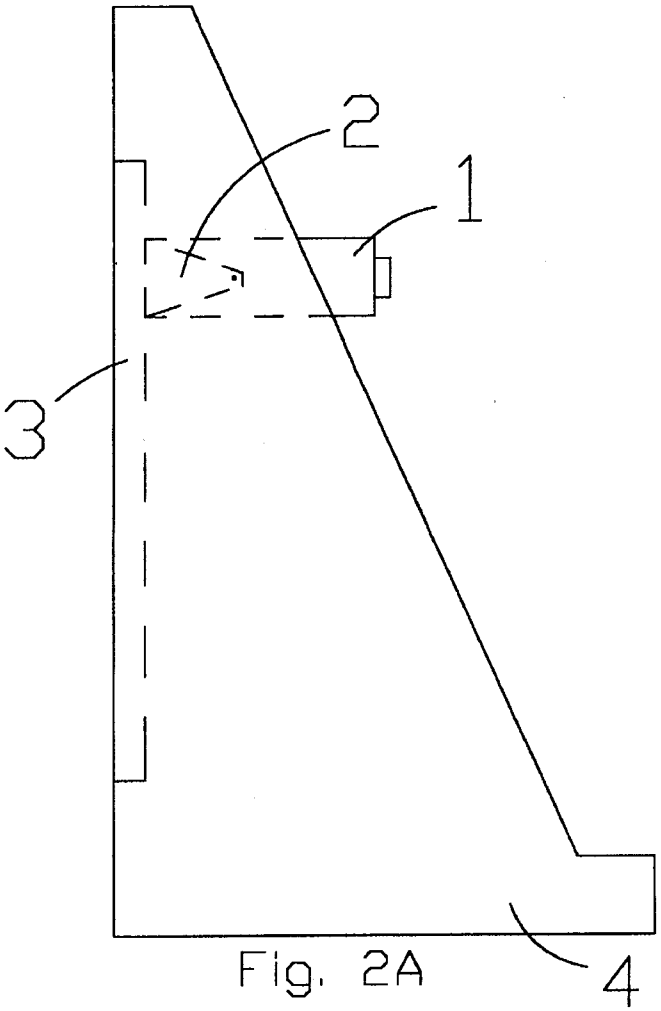
Figure 4:
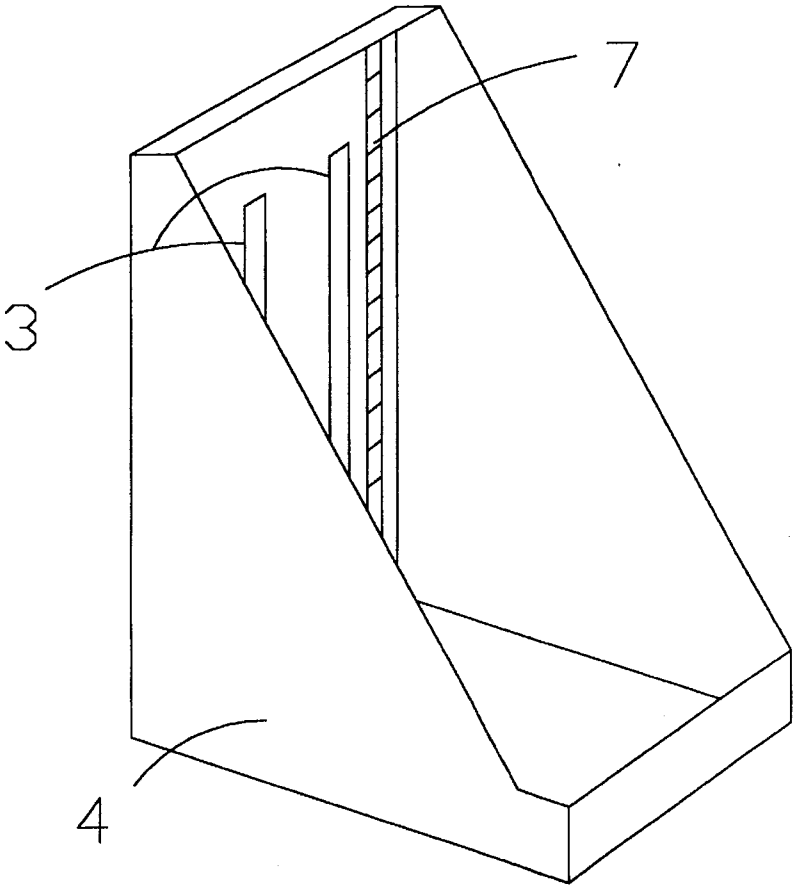
FIG. 4 is an oblique view of one section which is symmetrical in design with the other section.
Figure 3:
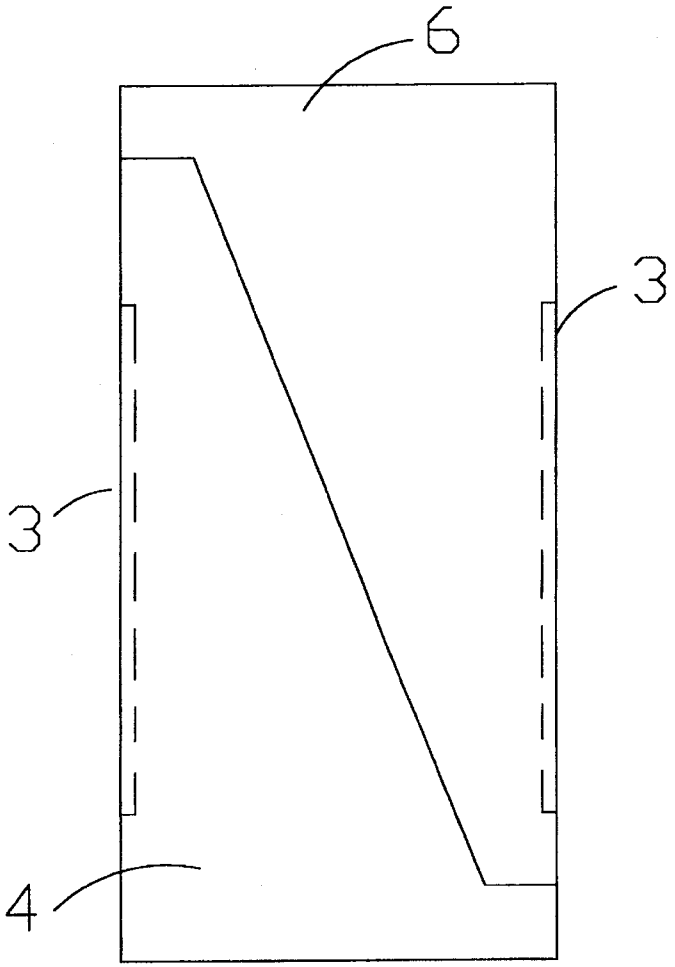
FIG. 3 is the vertical side view of the two sections joined and standing together as a whole unit.
Figure 5A:
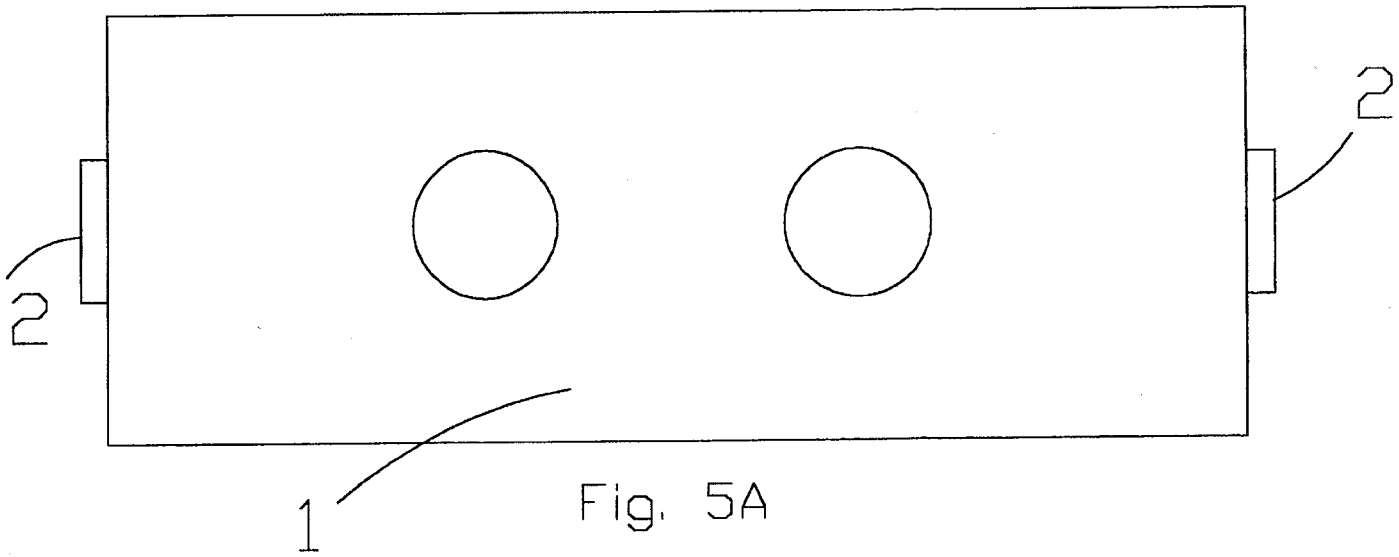
FIG. 5 shows the transceiver unit and the reflector. The transceiver unit has built-in visible and audible alarms.
Figure 5B:
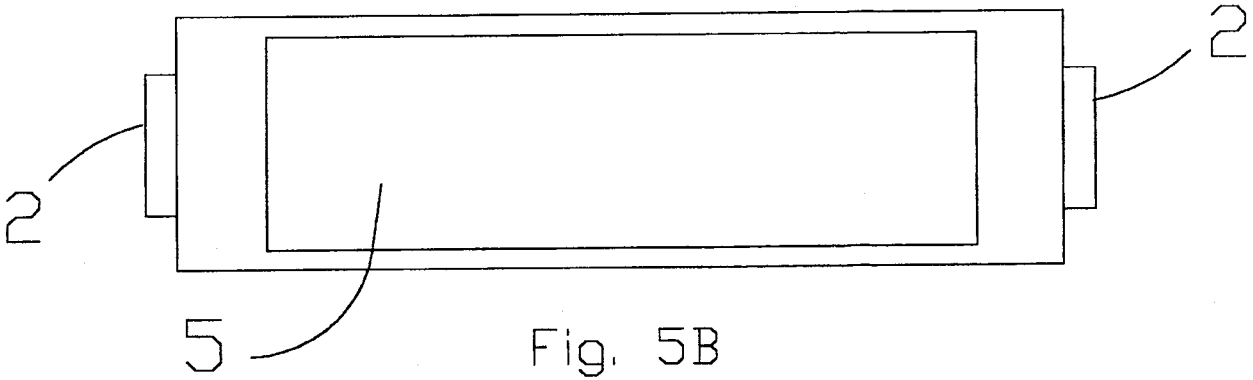
Figure 6C:
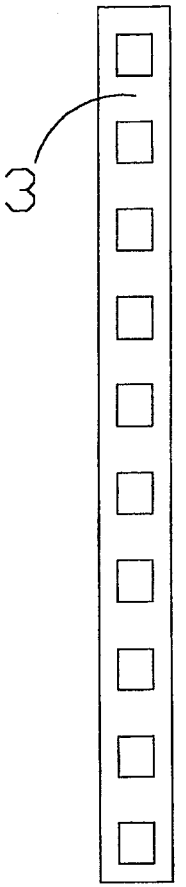
FIG. 6 shows one of the two brackets, which mount and hold the transceiver unit onto the tracks, in an optional arrangement.
Figure 6A:
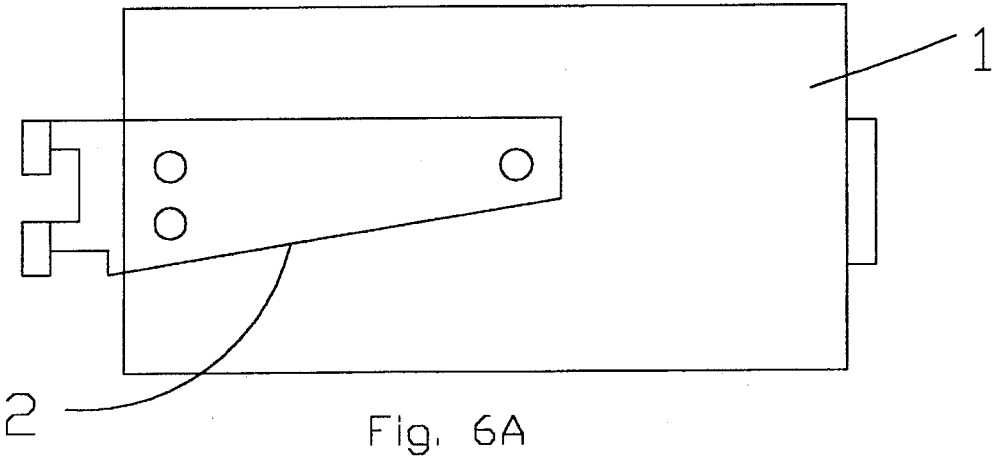
Figure 6B:
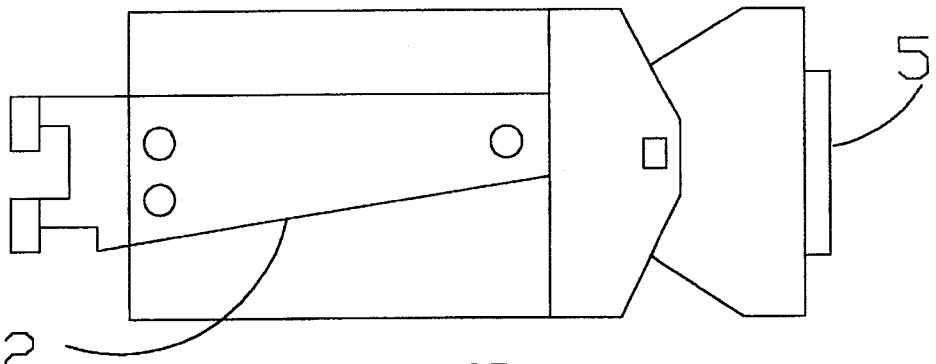

The preferred measuring device in accordance with the present invention includes a portable case (FIGS. 1, 2 and 3) of two sections, [4] and [6], made of wood or strong molded plastic material. The transceiver, (1) secured by brackets (2) is mounted on a set of tracks (3) so its height is adjustable in steps. Similarly the reflector (5) is mounted on a corresponding set of identical tracks (3) so that when the system is in alignment, the transceiver and the reflector are at the same height at each step. When the invisible radiation beam is continuous, as in the case where a skater successfully jumps over the beam, the alarm remains off or silent. When the same radiation beam is interrupted or cut, as in the case where a skater cannot clear the height of the beam, the alarm will light or sound to indicate the result. The power supply can be AC and/or DC. The scale gives an actual measurement in inches and/or centimeters.

In use, the sections could be placed about 4 to 10 meters, or 12 to over 30 feet, apart. While the audible alarm is off and the visible alarm is on, line up the system's transceiver and reflector and adjust it for an individual skater by lifting the respective units and position them along the tracks. Switch on the audible alarm and adjust the transceiver's sensitivity if necessary, so that a rapid brief interruption is detectable as indicated by a short beep.

The knockdown construction of the device, as shown in the drawings, allows it to be assembled and disassembled quickly and allows it to be transported easily such as in the trunk of an automobile. Preferably the height of the sections is at least about 3 feet or 1 meter.

I claim:

1. A highjump practice apparatus for use on an ice surface comprising a first portable housing means including a transceiver means for transmitting and receiving an electromagnetic wave, said transceiver means mounted to a set of brackets adjustable on a first set of tracks mounted within said first portable housing means, a second portable housing means including a reflector means for reflecting the electromagnetic wave transmitted by said transceiver means back to said transceiver means, said reflector means mounted to a set of brackets adjustable on a second set of tracks mounted within said second portable housing means, said first and second sets of tracks oriented in a substantially vertical direction to allow adjustment of said transceiver means and reflector means respectively in the vertical direction, said transceiver means having an alarm means to indicate an interruption of the transmission and reception of the electromagnetic wave, said first portable housing means and said second portable housing means having a symmetrical geometry such that said first portable housing means and said second portable housing means form a box when joined to each other by inverting the first housing means and stacking atop the second housing means, a scale mounted within each housing means adjacent each set of tracks for indicating a level of height said transceiver means and said reflector means are mounted at.

* * * * *